US005937448A

United States Patent [19]

Brill et al.

[11] Patent Number: 5,937,448

[45] Date of Patent: Aug. 17, 1999

[54] HYGIENIC TOILET SEAT

[75] Inventors: Alan Brill, Delray Beach; John Bollea, Lighthouse Point, both of Fla.; Dale Hoover, Los Gatos, Calif.

[73] Assignee: Brill Hygienic Products, Inc., Delray Beach, Fla.

[21] Appl. No.: 09/156,588

[22] Filed: Sep. 18, 1998

[51] Int. Cl.[6] ..... A47K 13/14

[52] U.S. Cl. ..... 4/243.2; 4/243.1

[58] Field of Search ..... 4/245.2, 245.1, 4/243.1, 243.2, 243.3, 244.1, 244.2

[56] References Cited

U.S. PATENT DOCUMENTS

| | | | |
|---|---|---|---|
| 4,213,212 | 7/1980 | Hefty et al. . | |
| 4,662,009 | 5/1987 | Hefty | 4/243.2 |
| 4,847,922 | 7/1989 | Iue-Tzung et al. | 4/243.2 |
| 5,253,372 | 10/1993 | Boker | 4/243.2 |
| 5,685,024 | 11/1997 | Chu et al. | 4/243.2 |

*Primary Examiner*—David J. Walczak
*Attorney, Agent, or Firm*—Quarles & Brady

[57] ABSTRACT

An improved electro-mechanical assembly is provided for advancing a tubular protective covering around a toilet seat. The covering is stored on a reel, and pulled off from the reel as it is replaced, and the used covering is taken up on a second reel. An activation button exposed through the top of the assembly is depressed to actuate a switch assembly which, in turn, actuates a drive mechanism. By actuating the drive mechanism, the cover is moved through a predetermined distance in such a manner that when it is in the mounted position, the toilet seat body is completely surrounded by the tubular cover. An upper housing portion has an integral pressure blade for exerting a constant downward force on the advancing protective covering. The pressure ensures adequate contact between the covering and a counter shaft assembly which communicates magnetically with internal electronic circuitry.

10 Claims, 4 Drawing Sheets

HYGIENIC TOILET SEAT

FIELD OF THE INVENTION

This invention relates generally to hygienic toilet seats and more particularly to an improved electro-mechanical assembly for fitting and changing a tubular cover of plastic film on a toilet seat.

BACKGROUND OF THE INVENTION

Toilet seats having a device for hygienic covering by a tubular film are known. For example, expired U.S. Pat. No. 4,213,212 to Hefty et al. teaches an arrangement for fitting and changing a tubular cover made of plastic film on a horseshoe shaped toilet seat. Generally, a roll of tubular toilet seat cover material extends from a supply reel, around the seat, to a take-up reel. The tubular cover is advanced one seat length between uses. The supply and take-up reels are contained, along with a motor, electric power source and pulley/gear arrangement, in a housing. In operation, the user actuates the motor by pressing a button or pulling a lever, thereby advancing the covering to provide one complete replacement of the tubular cover around the seat.

Various features of the device taught by Hefty et al. are capable of being improved upon. For instance, the known device does not include a means for detecting resistance changes during advancement of the tubular covering. Consequently, in instances where the cover material is torn or snared, the motor and gear assembly will continue to operate despite the lack of advancement of cover material around the seat. Furthermore, the quantity of covering material advanced may be insufficient due to slipping of tubing on the take up reel. Other limitations include extensive reliance on mechanical parts, such as gears, pulleys and belts, which are susceptible to failure. It would be desirable to provide an improved device overcoming the aforementioned limitations.

SUMMARY OF THE INVENTION

An improved electro-mechanical assembly is provided for advancing a tubular toilet seat cover material from a supply reel, around the seat, to a take-up reel. The supply and take-up reels are contained in a housing along with a motor, electric power source, and a printed circuit board assembly in electromagnetic communication with a counter mechanism.

The housing comprises a top cover and a base member which are secured with a key lock provided in the top cover. End caps extend through openings in a mounting bracket for attaching the assembly to the base of a toilet.

The assembly is provided with ribs extending entirely around the bottom surface of the seat for improved structural support. Drainage holes formed in the bottom of the base member allow removal of fluids which could have a deleterious effect on internal assembly components. The covering material extends from a dispense roll at one end of the assembly to a take-up roll at an opposite end of the assembly. At the latter end of the assembly, the cover material is slit by a razor blade protruding from an inside edge of the seat and extends over a counter shaft before being received on the take-up roll. The counter shaft is attached at one end to a magnet wheel which communicates with a printed circuit board to ensure accurate advancement of the cover material. The top cover of the improved assembly has an integral pressure blade which extends downward to apply pressure to the cover material. The pressure blade ensure adequate contact between the advancing cover material and the outer surface of the counter shaft.

An activation button is exposed through the top cover and provides a means for the user to actuate the motor, thereby advancing the seat cover material. The improved assembly incorporates an activation button which operates independently of the mechanical components of the assembly. In operation, the activation button actuates a switch assembly for activating the motor. Consequently, a drive shaft extending from the motor rotates a hub connected to the take-up shaft. As the take up shaft rotates, cover material is pulled off of the dispense roll and wound up on the take up roll.

DETAILED DESCRIPTION OF THE PREFERRED EMBODIMENTS

An improved electro-mechanical toilet seat assembly is provided for automatically advancing a tubular sheet of sanitary covering material around a horseshoe-shaped toilet seat. A roll of seat covering material is provided on a dispense shaft and consists of two plastic layers joined at opposite edges to form a tubular structure. In use, the covering material fits snugly around the toilet seat, yet is sufficiently loose to be advanced around the seat without tearing.

Figure 1:
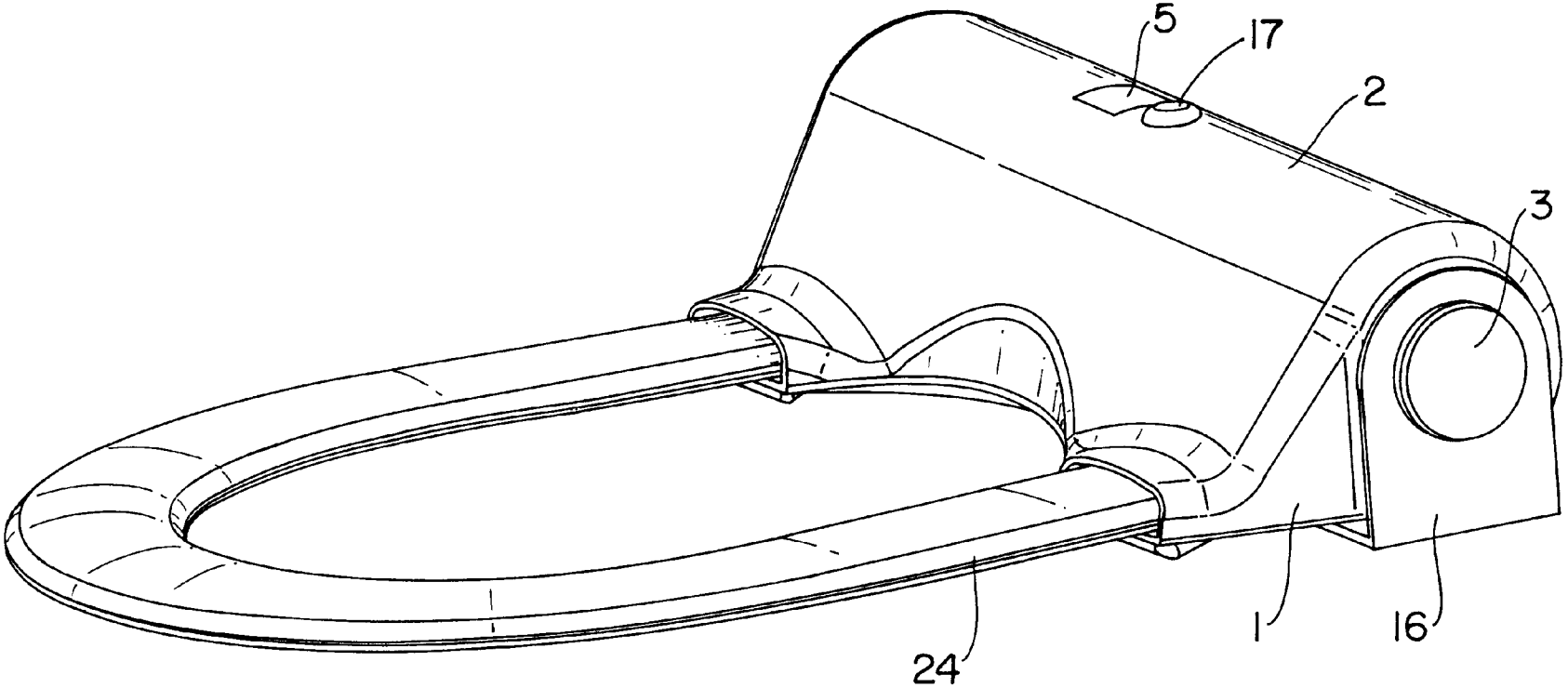
FIG. 1 is a perspective view of an assembled toilet seat in accordance with the present invention.

FIG. 1 illustrates an assembled improved hygienic toilet seat in accordance with the present invention. The major structural components of the assembly include a base member 1, a top cover 2, a seat 24 and a mounting bracket 16. As assembled, base member 1 and top cover 2 form a housing for protecting various internal components, including a motor subassembly 13 and electronic circuitry (not shown in FIG. 1). The improved seat assembly further incorporates heat shrink wrapping 55 over the motor subassembly to prevent potentially harmful agents, such as cleaning chemicals, from deteriorating motor subassembly components. An activation button 5 is exposed through an opening in the top cover 2. A standard key lock 17 is provided for locking the top cover in place. In operation, the activation button is manually depressed to advance the sanitary covering a sufficient length to provide a fresh seat covering. A mounting bracket is provided for attaching the unit to the base of a toilet. End caps 3 extending through aligned circular openings in mounting bracket 16 and base member 1, allow the entire seat assembly to be rotated about an imaginary axis joining the centers of the end caps.

Figure 4:
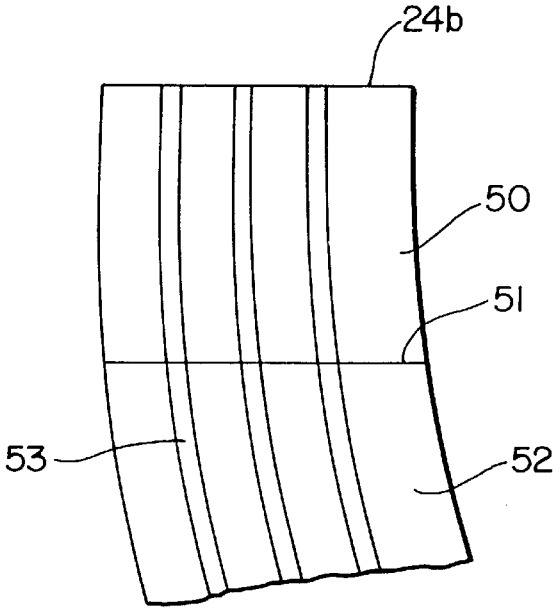
FIG. 4 is a partial bottom view of a toilet seat having structural support ribs in accordance with the present invention.
Figure 5:
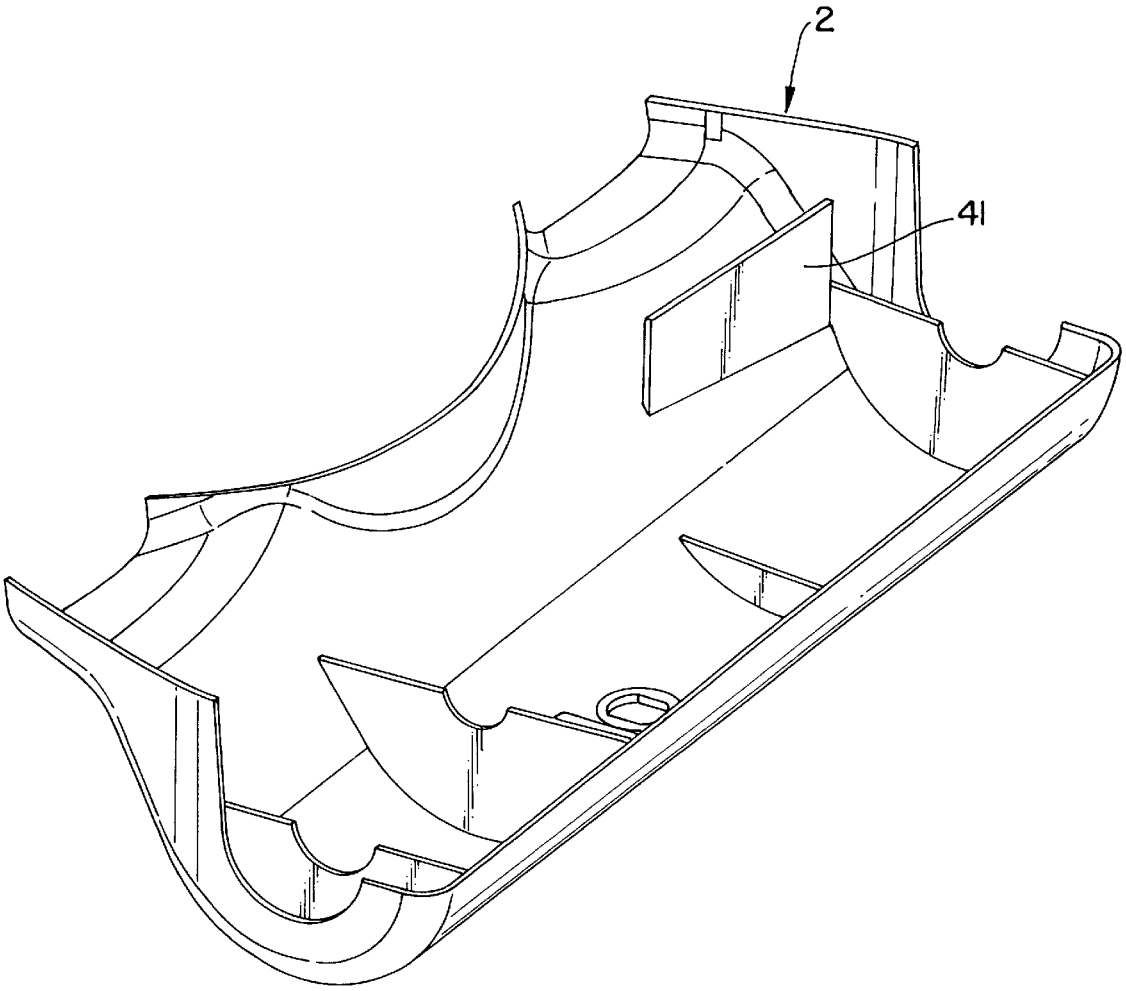
FIG. 5 is a perspective view of the inside surface of a top cover of the assembly in accordance with the present invention.

Structurally, components of the improved seat assembly are designed to provide improved mechanical strength. For instance, seat 24 has ribs extending completely around its underside. In particular, the ribs extend from end 24*a* to end 24*b*. Referring briefly to FIG. 4, a bottom view of seat end

24*b* is shown. Region 50 adjacent end 24*b* is generally thicker than the remainder of the seat. It is known to incorporate ribs to provide added structural support to the thinner portion of the seat. However, known seat assemblies have included support ribs 53 extending along the length of the seat terminating at the interface 51 between sections 50 and 52. According to the improved structure of the present invention, support ribs extend through the thickened section 50. As a result, the bending strength at interface 51 has been increased.

The improved seat assembly will now be described in more detail. Base member 1 preferably comprises a unitary molded plastic having a number of integrally molded support structures. In addition, the new seat assembly incorporates drain holes 57 extending through the bottom of the base member 1 to allow removal of fluids which could potentially accumulate in the housing and deteriorate internal components. Base member 1 includes partitions 30 and 31 for supporting a dispense roll shaft 54. Opposite ends of the dispense roll shaft are supported on recesses 32 formed in partitions 30 and 31. The improved seat assembly also incorporates integral stop mechanisms 33 for limiting horizontal movement of the dispense roll shaft.

The tubular cover material fits over free seat end 24*a*, which is not attached to the assembly. The cover material extends completely around the seat 24, over counter shaft 4, and is ultimately rewound on a take-up shaft 37. The take-up shaft is supported at one end by spring plate 11 attached to the outer surface of partition 38. The opposite end of the take-up roll mates with drive motor hub 8 which is attached to a drive shaft (not shown) extending from an end of motor 13.

Figure 3:
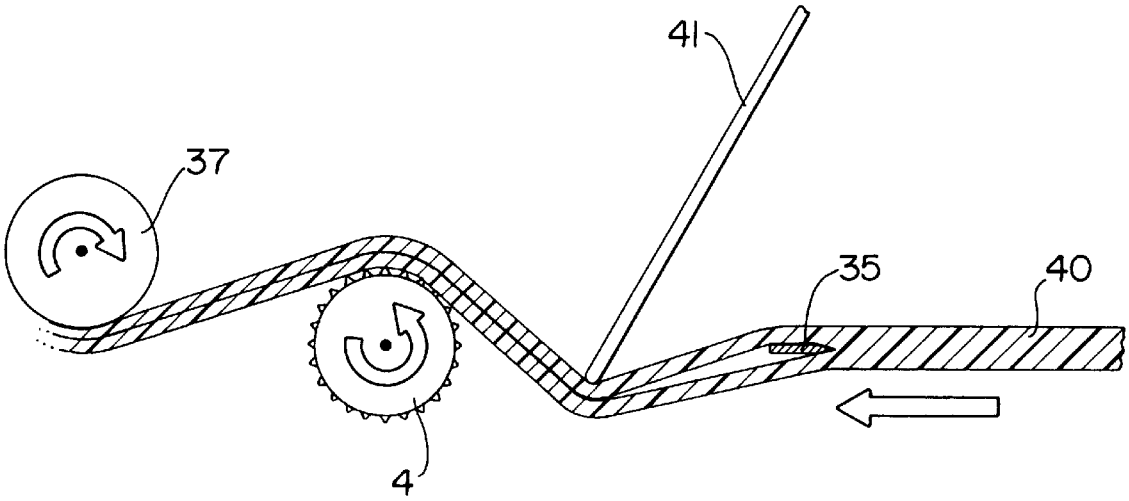
FIG. 3 is a schematic view illustrating improvements in the take-up region of the toilet seat assembly according to the present invention.

Toilet seat 24 has a slot 26 formed at one end for attachment of plate 34 and razor subassembly 25. Threaded studs 23 extending from attachment plate 9 pass through openings in base member 1 and plate 34. Attachment plates 9 and 34 are mechanically fastened to the base member. A portion of attachment plate 34 is integrally molded into slot 26 of seat 24. Razor subassembly 25, which fits into a wider section of slot 26, has an integrally molded raised bump formed on its surface for mating with an opening in plate 34. This feature of the improved assembly provides a means for releasably locking the razor blade assembly in place. The razor extends at an obtuse angle in relation to the advancing covering material, and serves to slit the edge of the cover material in order to allow it to be pulled off and wound up on the take-up shaft. Referring briefly to FIG. 3, as the tubular cover material 40 is advanced, the edge of the tubular covering adjacent the inside edge of the toilet seat contacts razor 35, slitting the side to allow it to pass plate 34 (not shown in FIG. 3) for receipt on take-up shaft 37. The improved seat assembly has an integral pressure plate 41 extending downward at an angle from the inner surface of top cover 2. Integral pressure plate 41 serves to press advancing cover material 40 against counter shaft 4 to improve contact between the cover material and the outer surface of the counter shaft.

Figure 2:
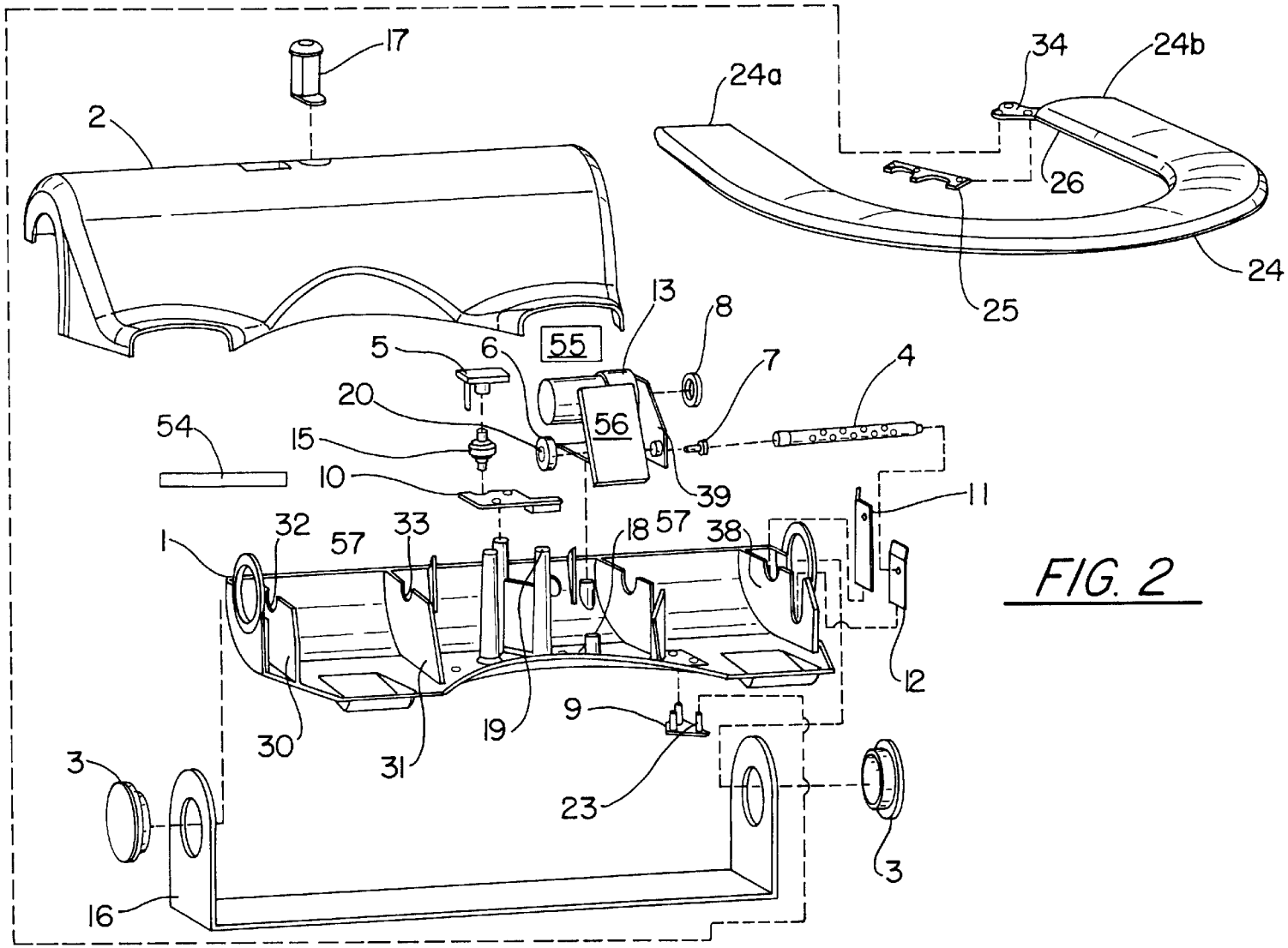
FIG. 2 is an exploded view of a toilet seat assembly in accordance with the present invention.

Referring back to FIG. 2, counter shaft 4 is supported at one end by spring plate 12 attached to the outer surface of partition 38. The opposite end of counter shaft 4 is joined to magnet wheel 6 via counter drive shaft element 7 extending through an opening in motor support plate 39. Counter shaft 4 is preferably formed of a molded plastic and has a plurality of integrally molded raised surface portions for gripping advancing cover material. In particular, the raised surface portions improve friction between the advancing cover material and the counter shaft surface, thereby improving rotational precision of the counter shaft during advancement of the cover material. As previously stated, the improved seat assembly incorporates a pressure blade integrally molded into top cover 2. In an assembled state, the pressure blade applies a downward force on the advancing cover material to further improve contact between the advancing cover material and the counter shaft surface.

Magnet wheel 6 has a magnet 20 attached to an outer wheel surface. The magnet 20 faces and communicates with electronic circuitry mounted on a printed circuit board assembly 56. The electronic circuitry of the improved assembly precisely monitors the number of rotations of wheel 6. Rotation of wheel 6 is a direct result of rotation of counter shaft 4. Consequently, resistance in the advancement of cover material, which affects the rotation of shaft 4, is detected by the electronic circuitry. In contrast to known devices, the circuitry of the present invention is designed to halt operation of motor 13 in instances where a specified resistance level is encountered. Motor subassembly 13 requires 12 volts dc which can be supplied via a 12 v dc converter or, alternatively, the assembly can be operated with batteries.

In contrast to prior art designs, the improved assembly of the present invention incorporates an activation button 5 operating independently of internal mechanical components, including the dispense and take up roll shafts. Consequently, activation of the assembly is not dependent upon the mechanical integrity of other assembly components. Furthermore, the button 5 has an improved ergonomic design which is less prone to damage by external forces.

In a released state, the upper surface of activation button 5 lies substantially flush with the upper surface of top cover 2 and the sides of the button are bounded by the periphery of the opening in the top cover through which the button is exposed. As a result, activation button motion is limited to vertical displacement upon contact. The activation button 5 also has an integrally molded guide leg 42 which is received in an opening in push switch assembly support plate 10 to prevent rotation of activation button 5 as it is being depressed. Support plate 10 is mechanically fastened to support plate mounting structure 19 integrally formed in base member 1. The improved structural integrity has resulted in an assembly having a corresponding reduction in required maintenance.

In operation, activation button 5 is pushed to actuate switch assembly 15 for activating motor assembly 13. A drive shaft extending from motor assembly 13 rotates hub 8 which, in turn, rotates the take-up shaft. As the take-up shaft is rotated, cover material is pulled off of the dispense shaft roll and advanced around toilet seat 24. Advancing cover material is forced against the outer surface of counter shaft 4 by pressure blade 41, causing counter shaft 4 to rotate. Rotation of the counter shaft 4 effects corresponding rotation of magnet 20 on magnet wheel 6. At seat end 24*b*, the left inside-facing edge of the cover is slit by razor assembly 26 in order to allow it to be wound up on take-up shaft 37. The amount of material advanced is determined by rotation of counter shaft 4. Specifically, rotations are computed by electronic circuitry (not shown) which tracks the rotation of magnet 20 on magnet wheel 6. Where specified resistance limits are exceeded, the electronic circuitry communicates with motor assembly 13 to halt operation of the motor.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. An improved sanitary toilet seat assembly for advancing a tubular sheet of plastic around a horseshoe-shaped toilet seat comprising a motor, a toilet seat having a first end and a thickened second end, an activation button, a base member and a top cover, the tubular sheet adapted to be conveyed from a dispense shaft proximate said first end to a take-up shaft proximate said second end, the toilet seat assembly further comprising:

a counter shaft having a plurality of pointed raised portions on a major surface thereof;

an integral pressure blade extending downward from an upper internal surface of said top cover, said integral pressure blade forcing said tubular sheet against said counter shaft major surface;

a magnet wheel having a magnet attached thereto;

a drive shaft connecting an end of said counter shaft to said magnet wheel; and a printed circuit board in communication with said motor and said magnet, wherein said tubular sheet is adapted to contact the major surface of said counter shaft such that advancement of said tubular sheet on to said take-up shaft effects rotation of said magnet wheel via rotation of said counter shaft.

2. An improved sanitary toilet seat assembly as recited in claim 1, wherein electronic circuitry on said printed circuit board detects resistance in the advancement of said tubular sheet by monitoring magnet rotation.

3. An improved sanitary toilet seat assembly as recited in claim 2, wherein said electronic circuitry halts operation of said motor upon detecting a specified resistance in the advancement of said tubular sheet.

4. An improved toilet seat assembly as recited in claim 1, wherein a bottom side of said toilet seat has integral ribs extending from said first end to said second end.

5. An improved toilet seat assembly as recited in claim 1, wherein said base member has drainage apertures extending therethrough.

6. An improved sanitary toilet seat assembly as recited in claim 1, further comprising a heat shrinkable plastic wrapped around said motor.

7. An improved toilet seat assembly as recited in claim 1, wherein said activation button has an integrally molded guide leg extending downward therefrom.

8. An improved sanitary toilet seat assembly as recited in claim 1, wherein said activation button operates independently of said dispense and take-up shafts.

9. An improved sanitary toilet seat assembly as recited in claim 1, wherein an upper surface of said activation button lies substantially flush with an upper surface of said top cover in a released state.

10. An improved sanitary toilet seat assembly as recited in claim 1, wherein the periphery of said activation button is bounded by the periphery of an opening in said top cover when said button is in a released state.

* * * * *